United States Patent [19]

Hieber et al.

[11] 3,958,071

[45] May 18, 1976

[54] ELECTRICAL RESISTOR AND METHOD OF PRODUCING SAME

[75] Inventors: Konrad Hieber, Munich; Alfred Politycki, Ottobrunn, both of Germany

[73] Assignee: Siemens Aktiengesellschaft, Berlin & Munich, Germany

[22] Filed: Feb. 26, 1973

[21] Appl. No.: 335,666

[30] Foreign Application Priority Data

Mar. 6, 1972 Germany ..... 2210742

[52] U.S. Cl. ..... 428/411; 427/101; 427/249; 427/252

[51] Int. Cl.[2] ..... C23C 11/00; C23C 11/02

[58] Field of Search ..... 117/107.2 R, 226, 227; 427/249, 252, 101; 428/457, 411

[56] References Cited

UNITED STATES PATENTS

| | | | |
|---|---|---|---|
| 2,183,302 | 12/1939 | Brauer | 117/107.2 R X |
| 2,785,997 | 3/1957 | Marvin | 117/107.2 R X |
| 2,803,729 | 8/1957 | Kohring | 117/227 X |
| 2,815,302 | 12/1957 | Ostrufsky et al. | 117/107.2 R X |
| 2,901,381 | 8/1959 | Teal | 117/107.2 R X |
| 2,921,871 | 1/1960 | Cummins | 117/227 |
| 2,933,415 | 4/1960 | Homer et al. | 117/107.2 R X |
| 3,050,417 | 8/1962 | Nack et al. | 117/107.2 R X |
| 3,092,510 | 6/1963 | Edelman | 117/107.2 R X |
| 3,107,179 | 10/1963 | Kohring | 117/107.2 R X |
| 3,109,754 | 11/1963 | Tielens et al. | 117/227 X |
| 3,188,230 | 6/1965 | Bakish et al. | 117/107.2 R X |
| 3,669,724 | 6/1972 | Brand | 117/107.2 R X |

OTHER PUBLICATIONS

Vapor Deposition, Powell et al. Ed., John Wiley & Sons, Inc., New York, 1966, pp. 352–355, 358, 488–489.

*Primary Examiner*—Harris A. Pitlick
*Attorney, Agent, or Firm*—Hill, Gross, Simpson, Van Santen, Steadman, Chiara & Simpson

[57] ABSTRACT

A resistor comprising a layer of material disposed on a substrate which layer contains a metal component which can be either a pure metal or a metal alloy and which has carbon inserted therein to vary the specific resistance and the temperature coefficient of the electrical resistance. The method of producing the resistor comprises providing a metal-organic compound such as nickel acetylacetonate which is evaporated and carried by a carrier gas, such as hydrogen or ammonia, to a heated substrate. When the vaporized metal-organic compound contacts the heated substrate it decomposes to provide a layer having a metal component with carbon inserted in the component. By controlling the temperature of the heated substrate and by controlling the pressure of the carrier gas, the volume percent of carbon inserted into the metal component when forming the layer can be controlled to vary both the specific resistance of the layer and the temperature coefficient of the electrical resistance.

8 Claims, 3 Drawing Figures

ELECTRICAL RESISTOR AND METHOD OF PRODUCING SAME

BACKGROUND OF THE INVENTION

1. Field of the Invention

The present invention is directed to an electrical resistor having a substrate with a layer of metal or metal alloy in which carbon has been inserted to vary the temperature coefficient of the electrical resistance and the specific resistance and to the method of producing the electrical resistor.

2. Prior Art

Resistance layers comprising a metal component such as a metal or a metal alloy with carbon inserted therein are well-known in the prior art. One proposed method for producing such resistors is by evaporating the metal of the resistance layer onto a substrate by a process using an electron beam to evaporate either tungsten or molybdenum respectively in the presence of a carbon containing gas. Due to the reaction occurring during evaporation, carbon is supposed to influence the temperature coefficient of the electrical resistor. Such a process is disclosed in the German Offenlegungsschrift No. 1,931,412. Two drawbacks of this process is that the method is time consuming and the apparatus for performing the method is extremely expensive.

Another method involves a pyrolytic decomposition of a metal-organic compound dissolved in a solution by submerging a heated substrate, which receives the layer, in the solution. In this process, which is described in German Offenlegungsschrift No. 1,540,166, the metal matrix of the layer may contain between 1 and 15 volume percent carbon. However, this method has several drawbacks. During the pyrolytic decomposition of the metal-organic compound, it is difficult to maintain the concentration of the compound in the solution. Another drawback is the fact that only a maximum of 15 volume percent of carbon can be introduced into the metal or metal alloy matrix.

Resistors, which comprise a layer on a substrate and have a high resistance, are known. They were produced by either reducing the layer thickness of the resistance layer or by a corresponding selection of the geometric factors of the resistor layers. The electrical characteristics of the layer could be changed by a diffusion process or by a corrosion process. However, since the composition of the resistance layer comprises an essential portion of the entire layer, particularly in very thin resistance layers (5 to 10nm or 50 or 100 angstroms), the changing of the layer thickness or geometric factors by the above process involves a great danger of undesirably changing the electrical properties of the resistor due to minor changes in the composition of the layers.

SUMMARY OF THE INVENTION

The present invention is directed to an electrical resistor and the method of making the resistor which method does not require expensive equipment and is not time consuming. The method enables the amount of carbon introduced into a layer consisting of a metal component and carbon to be varied almost unlimitedly within a range between 0 and 100% carbon. The method comprises heating one or more metal-organic compounds to evaporate a gas phase in the presence of a carrier gas and thermically decomposing the gas phase as it contacts a heated substrate to deposite a layer on the substrate. During the thermic decomposition or pyrolysis of the vaporized metal-organic compound, the carbon content of the layer can be controlled by varying the temperature of the heated substrate and by controlling the pressure or flow rate of the carrier gas. By changing the composition of the carrier gas, the amount of carbon inserted into the layer can also be varied. By controlling the carbon the content in the layer of a selected metal or metal alloy and carbon, the method enables the production of resistance layers having the desired specific resistivity and temperature coefficient of electric resistance or temperature coefficient of resistivity.

In accordance with the method, it is possible to adjust the temperature coefficient of the electrical resistor between a value of the pure metal layer and a value of pure carbon layer by means of controlling the carbon concentration in the layer. Furthermore, the resistivity of the layer can be influenced and controlled independently from the temperature coefficient by controlling the carbon structure for instance by controlling both the pressure of the carrier gas and the substrate temperature. Thus, a resistor with high resistance can be produced by the present method by increasing carbon content of the layer to increase the resistivity of the layer.

An additional advantage of the method according to the present invention is that it enables the production of a resistance layer on a substrate using an inexpensive evaporation system. The method also enables the production of either a metal-carbon layer or a metal alloy-carbon layer for a cost lower than the cost of the previously known methods. An advantage of the resistance layer containing carbon produced according to the present method is that the layer unites the advantages of a pure metal layer and pure carbon resistance layer. Some pure metal layers have a small temperature coefficience for the electrical resistance and the carbon resistance layers have a high overload capacity during operation with current pulses of great amplitude and are also corrosion resistant.

DESCRIPTION OF THE PREFERRED EMBODIMENTS

The principles of the present invention are particularly useful in producing a resistor comprising a metal layer deposited upon a substrate. According to the present invention, the metal layer which may comprise either a metal or a metal alloy, has carbon inserted or deposited in the metal or metal alloy matrix during its formation. Preferably, an acetylacetonate of the metal or metal alloys, respectively, are preferably evaporated by means of heating and deposited on the substrate by means of a chemical vapor deposition (CVD). The chemical deposition of the vaporized metal organic compound is a thermic decomposition or pyrolysis of the vaporized metal-organic compound, which is in the presence of a carrier gas of a given pressure, by contacting this mixture of the carrier gas and the evaporated metal-organic compound on a heated surface of the substrate which has been heated preferably in a temperature range of 250° to 600° C. Preferably, the carrier gas is either hydrogen or ammonia to produce a reducing atmosphere; however, a mixture of hydrogen and nitrogen can also be used. Thus, the carrier gas is a reducing gas and is preferably selected from a group consisting of hydrogen, ammonia and a mixture of hydrogen and nitrogen.

Figure 1:
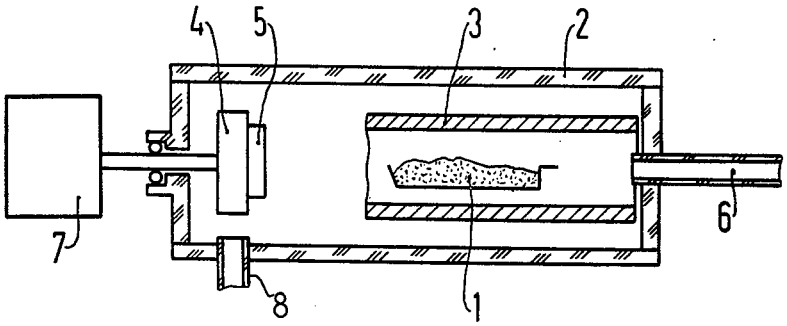
FIG. 1 is a schematic presentation of an arrangement or apparatus for producing the resistance layer according to the method of the present invention.

An apparatus and arrangement for performing the method in accordance with the invention is diagrammatically illustrated in FIG. 1. A tray or container of a metal-organic compound 1, which may be in the form of a powder, is placed in a tubular oven or furnace 3 which is contained in a sealed quartz tube 2 which forms a vacuum chamber. A carrier gas at subatmospheric pressure is introduced into the sealed quartz tube 2 through a tube 6 and flows through the oven or furnace 3 to carry the vapor of the metal-organic compound therefrom and towards a rotating plate 4 on which a substrate 5 is mounted. The plate 4 as illustrated can be rotated by a conventional means 7 such as a motor or other drive mechanism having a shaft extending into the tube 2 through an appropriate seal. The plate 4 preferably consists of copper and is provided with means for heating the plate. To remove the excess carrier gas and other gases from the tube 2, tube 8 is provided.

The operation of the device illustrated in FIG. 1 will be discussed by the performance of the method for depositing a nickel layer which contains carbon on the substrate 5. The metal-organic compound of nickel acetylacetonate is the initial material for the process. The powdered — shaped nickel acetylacetonate is heated in the oven 3 to a temperature range of between 150° and 180° C and thereby evaporates. Preferably, the evaporated compound is moved by a carrier gas such as ammonia or hydrogen against the surface of the substrate 5 which preferably consists of a ceramic or glass and is heated in a temperature range between 250° and 600° C depending on the desired properties of the resistance layer. In the reducing atmosphere, when the gaseous nickel acetylacetonate contacts the heated substrate, nickel, acetone, water and hydrocarbons are created. A portion of the hydrocarbons contacting the heated substrate 5 are reduced to become elemental carbon and thus the carrier gas acts as part of the reduction means.

By controlling the temperature of the substrate, the amount of carbon deposited in the nickel layer produced on the substrate can be controlled. When the carrier gas is hydrogen, the substrate temperature is preferably in the range of 250° to 480° C and when the carrier gas is ammonia, the substrate temperature is preferably in the range of 350° to 660° C. As the temperature of the substrate 5 is increased in these two ranges, more carbon will be deposited and thus by specifically controlling the temperature of the substrate, the amount of carbon inserted in a nickel layer can be controlled.

The method of the present invention, allows the production of a resistance layer of either a metal or metal alloy with an exactly controlled carbon concentration.

Thus the concentration of the carbon, which is to be introduced into the metal matrix of the layer is unlimited and can be preselected to be in a concentration range of between 0 and 100%. The changes in the decomposition temperature, the selection of the carrier gas and a change of the flow rate or the pressure of the carrier gas are decisive for determining the exact carbon content. The resistivity $\rho c$ of the carbon depends on the particular crystal structure of the carbon. This structure can be influenced by the above stated parameters for instance, $\rho c = 10^7\ \mu\ \omega$ cm with a TCR (temperature coefficient of resistance) of -2000 ppm/degree while utilizing hydrogen as a carrier gas or $\rho c = 10^4\ \mu\ \omega$ cm with a TCR of −500 ppm/degree while utilizing ammonia gas as the carrier gas. With the aid of the method of the present invention, the value of the temperature coefficient of electrical resistance can be adjusted by the selection of the desired parameters with respect to each other to obtain a value between the value of a pure metal and metal alloy for instance +400 through +6000 ppm/degree and the value of pure carbon for instance −500 through −2000 ppm/degree and independently therefrom, the specific resistance can be also selected.

Figure 2:
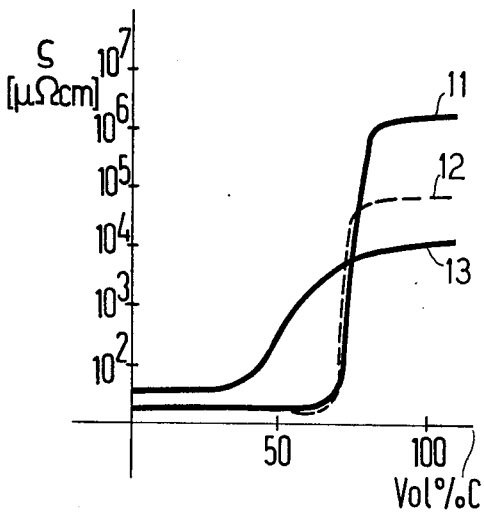
FIG. 2 is a schematic presentation of the dependency of the resistivity or specific resistivity of the different metal resistant layers which are produced according to the present invention on the amount of carbon contained in a layer.
Figure 3:
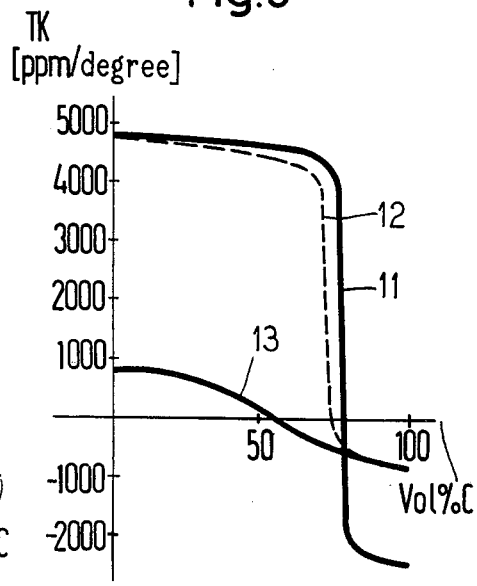
FIG. 3 is a schematic presentation of the dependency of the temperature coefficient of the electrical resistance or temperature coefficient of resistivity for different metal layers on the amount of carbon in the layer.

FIGS. 2 and 3 show the changes of the resistivity or specific resistivity (FIG. 2) and a temperature coefficient (FIG. 3) for different metals and metal alloys depending on the amount of carbon contained therein. The reference numeral 11 identifying a curve for a nickel-carbon resistance layer which was produced by the method of the present invention using hydrogen at a pressure of 720 Torr as the carrier gas. The reference numeral 12 identifies a curve for a nickel-carbon resistance layer which was produced by the method of the present invention using ammonia gas at a pressure of 50 Torr as the carrier gas. Since a rather steep change in the specific resistivity and temperature coefficient of electrical resistance or temperature coefficient of resistivity occurs when the carbon content is between approximately 50 and 80%, it is difficult to obtain reproducible values for both the resistivity and the temperature coefficient of electrical resistance when the layer contains this percentage range of carbon. In order to select a curve of the temperature coefficient of electrical resistance dependent on the amount of carbon or a curve of the resistivity dependent on the amount of carbon, it is advantageous to select a metal or metal alloy-carbon resistance layer, respectively, in such a way that the temperature coefficient for the electrical resistance of the pure metal or pure metal alloy, respectively, has a smaller value and the specific resistivity of the pure metal or pure metal alloy, respectively, has a greater value than the corresponding value of the materials of curve 11 and 12.

Curve 13 shows the dependency of a nickel-chromium alloy or nickel-copper alloy layer on the carbon content contained therein.

The nickel-chromium alloy layer is produced by the method using a mixture of nickel acetylacetonate and chromium acetylacetonate as the metal-organic compound. The use of a mixture of nickel acetylacetonate and copper acetylacetonate as the compound in the method will produce the nickel copper alloy layer. In addition, the method can produce a nickel-cobalt alloy layer by using a mixture of acetylacetonates of these two metals.

Although various minor modifications might be suggested by those versed in the art, we wish to include within the scope of the patent granted hereon all such modifications as reasonably and properly come within the scope of our contribution to the art.

We claim:

1. A method for producing electrical resistor comprising a layer disposed on a substrate, said layer having a metal component selected from a metal and metal alloy and a carbon component wherein the temperature coefficient of the resistivity and the specific resistivity of the layer are influenced by the amount of carbon introduced into the layer, said method comprising the steps of providing at least one metal-organic compound selected from a group consisting of a metal acetylacetonate and mixtures of metal acetylacetonates and a substrate in a vacuum chamber; heating the metal-organic compound to evaporate a gas phase of the compound; providing a carrier gas selected from a group consisting of hydrogen, ammonia and a mixture of hydrogen and nitrogen under pressure, introducing the carrier gas into the chamber for transporting the gas phase of the metal organic compound to the substrate upon which the layer is to be deposited; and heating the substrate to a temperature in a range of 250° to 600°C to cause a thermic decomposition of the gas phase of the metal-organic compound to deposit a layer consisting of the metal component and the carbon, whereby said pressure of the carrier gas is such that both carbon and the metal component are deposited and the amount of carbon present in the layer depends upon the temperature of the substrate.

2. A method according to claim 1, wherein the metal-organic compound is nickel acetylacetonate and the carrier gas is hydrogen, wherein the heating of the substrate provides a substrate with a temperature in the range of 250° to 480°C, and wherein the pressure of the carrier gas is in the amount of 720 Torr.

3. A method according to claim 1, wherein the metal-organic compound is nickel acetylacetonate and the carrier gas is ammonia gas, wherein the heating of the substrate provides a substrate with a temperature in the range of 350° to 600°C, and wherein the pressure of the carrier gas is 50 Torr.

4. A method according to claim 1, wherein the metal-organic compounds is a mixture of nickel acetylacetonate and chromium acetylacetonate.

5. A method according to claim 1, wherein the organic compounds comprise a mixture of nickel acetylacetonate and copper acetylacetonate.

6. A method according to claim 1, wherein the organic compounds is a mixture of nickel acetylacetonate and cobalt acetylacetonate.

7. An electrical resistor produced by the method of claim 1, wherein the temperature coefficient of resistivity of the layer is in the range of +100 through −500 ppm/degree.

8. An electrical resistor produced by the method of claim 1, wherein the specific resistivity is within a range of 100 $\mu\omega$ cm up to $10^5$ $\mu\omega$ cm.

* * * * *